US012065821B2

(12) United States Patent
Spires et al.

(10) Patent No.: US 12,065,821 B2
(45) **Date of Patent: *Aug. 20, 2024**

(54) SYSTEMS, APPARATUS, AND METHODS FOR MAINTENANCE OF STORMWATER MANAGEMENT SYSTEMS

(71) Applicant: ADVANCED DRAINAGE SYSTEMS, INC., Hilliard, OH (US)

(72) Inventors: Gregory Spires, Powell, OH (US); Brian Rustia, Fairfax Station, VA (US); Evan Geno, Malinta, OH (US); Michael Kuehn, Higganum, CT (US)

(73) Assignee: Advanced Drainage Systems, Inc., Hilliard, OH (US)

( * ) Notice: Subject to any disclaimer, the term of this patent is extended or adjusted under 35 U.S.C. 154(b) by 504 days.

This patent is subject to a terminal disclaimer.

(21) Appl. No.: 17/333,292

(22) Filed: May 28, 2021

(65) Prior Publication Data

US 2021/0285203 A1 Sep. 16, 2021

Related U.S. Application Data

(63) Continuation of application No. 16/938,657, filed on Jul. 24, 2020, now Pat. No. 11,028,570, which is a (Continued)

(51) Int. Cl.
*E03F 5/10* (2006.01)

(52) U.S. Cl.
CPC ..... *E03F 5/106* (2013.01)

(58) Field of Classification Search
CPC ..... E03F 1/002; E03F 1/003; E03F 5/106
See application file for complete search history.

(56) References Cited

U.S. PATENT DOCUMENTS 980,442 A 1/1911 Schlafly
2,334,779 A 11/1943 Luff
(Continued)

FOREIGN PATENT DOCUMENTS

CN 108487410 A 9/2018

OTHER PUBLICATIONS

Advanced Drainage Systems, Inc., *ADS Driveway Culvert Installation*, Feb. 5, 2013, YouTube, retrieved Sep. 21, 2020, from https://www.youtube.com/watch?v=r817BfCtRGU (3 pages).
(Continued)

*Primary Examiner* — Tara Mayo-Pinnock
(74) *Attorney, Agent, or Firm* — FINNEGAN, HENDERSON, FARABOW, GARRETT & DUNNER L.L.P.

(57) ABSTRACT

Stormwater management systems, methods, and apparatuses for containing and filtering runoff may be provided. In one implementation, a flared end ramp for managing flow of material into a stormwater chamber may be provided. The flared end ramp may include an inlet end configured for connection with a pipe, a side wall of the flared end ramp having a rounded profile at the inlet end; an outlet end configured for placement within the stormwater chamber; and an inclined surface extending between the inlet end and the outlet end of the flared end ramp and configured to deliver material from the pipe into the stormwater chamber. The outlet end of the flared end ramp may have a larger width than the inlet end of the flared end ramp such that the inclined surface is angled laterally outward from the inlet end toward the outlet end.

19 Claims, 11 Drawing Sheets

Related U.S. Application Data continuation-in-part of application No. 16/670,628, filed on Oct. 31, 2019, now abandoned, and a continuation-in-part of application No. PCT/US2019/059283, filed on Oct. 31, 2019.

(60) Provisional application No. 62/753,050, filed on Oct. 30, 2018.

(56) References Cited

U.S. PATENT DOCUMENTS 3,048,983 A * 8/1962 Crummel ..... E04D 13/08 404/2
4,245,924 A 1/1981 Fouss
4,246,936 A 1/1981 Luz
4,359,167 A 11/1982 Fouss
4,523,613 A 6/1985 Fouss
4,759,661 A 7/1988 Nichols
4,824,287 A 4/1989 Tracy
5,017,041 A 5/1991 Nichols
5,065,554 A 11/1991 Neva
5,087,151 A 2/1992 DiTullio
5,129,758 A 7/1992 Lindstrom
5,156,488 A 10/1992 Nichols
5,336,017 A 8/1994 Nichols
5,358,006 A 10/1994 Sweers
5,401,459 A 3/1995 Nichols
5,419,838 A 5/1995 DiTullio
5,441,363 A 8/1995 Gray
5,498,104 A 3/1996 Gray
5,511,903 A 4/1996 Nichols
5,556,231 A 9/1996 Sidaway et al.
5,588,778 A 12/1996 Nichols
5,658,092 A 8/1997 Sweers
5,839,844 A 11/1998 Nichols et al.
5,890,837 A 4/1999 Wells
5,890,838 A 4/1999 Moore, Jr.
6,076,993 A 6/2000 Gray
6,270,287 B1 8/2001 Gray
6,345,791 B1 * 2/2002 McClure ..... B64C 21/10 244/130
6,350,374 B1 2/2002 Stever
6,361,248 B1 3/2002 Maestro
6,533,498 B1 3/2003 Quin
D477,381 S 7/2003 Benecke
6,602,023 B2 8/2003 Crescenzi
6,612,777 B2 9/2003 Maestro
6,698,975 B1 3/2004 Benecke
6,991,734 B1 1/2006 Smith et al.
7,008,138 B2 3/2006 Burnes
7,052,209 B1 5/2006 Kruger
7,118,306 B2 10/2006 Kruger
7,134,808 B2 11/2006 Albone
D537,912 S 3/2007 Benecke
7,189,027 B2 3/2007 Brochu
7,217,063 B2 5/2007 Moore, Jr.
7,226,241 B2 6/2007 DiTullio
7,237,981 B1 7/2007 Vitarelli
D549,836 S 8/2007 Desbiens
7,273,330 B1 9/2007 Brochu
7,300,226 B1 11/2007 Maestro
7,306,399 B1 12/2007 Smith
D566,852 S 4/2008 Gaster
7,351,005 B2 4/2008 Potts
7,364,384 B1 4/2008 Swistak
7,384,212 B2 6/2008 Currivan
7,419,332 B1 9/2008 Brochu
7,473,053 B1 1/2009 Brochu
7,500,805 B1 3/2009 Brochu
7,517,172 B2 4/2009 Sipaila
7,611,306 B1 11/2009 Hallahan
7,614,825 B2 11/2009 Kroger
7,628,566 B2 12/2009 Miskovich
7,798,747 B1 9/2010 de Bruijn
7,806,627 B2 10/2010 DiTullio
7,887,256 B2 2/2011 Miskovich
7,914,231 B2 3/2011 Coppes
D638,094 S 5/2011 DiTullio
D638,095 S 5/2011 DiTullio
8,007,201 B2 8/2011 Currivan
D653,352 S 1/2012 Jacques
8,147,688 B2 4/2012 Adams
8,366,346 B2 2/2013 DiTullio
8,414,222 B2 4/2013 DiTullio
8,425,148 B2 4/2013 DiTullio
8,491,224 B2 7/2013 Cobb
8,636,444 B2 1/2014 Currivan
8,672,583 B1 3/2014 Mailhot
8,858,119 B2 10/2014 Wynne
8,955,258 B2 2/2015 Jacques
D728,825 S 5/2015 Miskovich
9,290,924 B2 3/2016 Wynne
9,556,576 B2 1/2017 Mailhot
9,580,898 B2 2/2017 Wynne
9,637,907 B2 5/2017 Mailhot
9,765,509 B1 9/2017 DiTullio
9,809,968 B1 11/2017 Holbrook
D806,827 S 1/2018 Mailhot
D840,499 S 2/2019 DiTullio
2002/0025226 A1 2/2002 Maestro
2002/0044833 A1 4/2002 Kruger
2002/0067952 A1 6/2002 Crescenzi et al.
2003/0095838 A1 5/2003 Maestro
2004/0184884 A1 9/2004 DiTullio
2005/0074285 A1 4/2005 Burnes
2005/0074287 A1 4/2005 Brochu
2005/0074288 A1 4/2005 Moore, Jr.
2005/0111915 A1 5/2005 Moore, Jr.
2005/0238434 A1 10/2005 Coppes
2007/0258770 A1 11/2007 Miskovich
2008/0138156 A1 6/2008 Janesky
2008/0226394 A1 9/2008 Coppes
2008/0240859 A1 10/2008 Sipaila
2009/0003933 A1 1/2009 Anderson et al.
2009/0220302 A1 9/2009 Cobb et al.
2010/0059430 A1 3/2010 Adams et al.
2010/0329787 A1 12/2010 Moore, Jr. et al.
2011/0200391 A1 8/2011 Mailhot et al.
2012/0085431 A1 4/2012 Spano, Jr. et al.
2015/0211198 A1 7/2015 Mailhot
2018/0010325 A1 1/2018 Mailhot et al.

OTHER PUBLICATIONS

Advanced Drainage Systems, Inc., *StormTech Installation*, Mar. 6, 2015, YouTube, retrieved Sep. 21, 2020, from https://www.youtube.com/watch?v=-PZ9P2NyD44 (4 pages).

International Search Report and Written Opinion of the International Searching Authority from the U.S. Patent and Trademark Office for related International Application No. PCT/US2019/059283, mailed Aug. 12, 2020 (9 pages).

International Search Report and Written Opinion of the International Searching Authority from the U.S. Patent and Trademark Office for related International Application No. PCT/US2020/043543, mailed Oct. 8, 2020 (10 pages).

International Search Report and Written Opinion of the International Searching Authority from the U.S. Patent and Trademark Office for related International Application No. PCT/US2020/043557, mailed Sep. 16, 2020 (7 pages).

* cited by examiner

SYSTEMS, APPARATUS, AND METHODS FOR MAINTENANCE OF STORMWATER MANAGEMENT SYSTEMS

CROSS-REFERENCE TO RELATED APPLICATIONS

This application is a continuation of U.S. application Ser. No. 16/938,657, filed Jul. 24, 2020, now U.S. Pat. No. 11,028,570, which is a Continuation-in-Part of International Application No. PCT/US2019/059283, filed Oct. 31, 2019, and a Continuation-in-Part of U.S. application Ser. No. 16/670,628, filed Oct. 31, 2019, both of which claim the benefit of U.S. Provisional Application No. 62/753,050, filed Oct. 30, 2018, all of which are hereby incorporated by reference in their entireties.

TECHNICAL FIELD

This disclosure relates generally to systems, apparatus, and methods for fluid run-off management systems. In particular, this disclosure relates to enhancing efficiency and efficacy of fluid run-off system maintenance.

BACKGROUND

Fluid run-off systems include systems designed to process rainwater or other fluid run-off and particularly stormwater. Related stormwater management systems known in the art include chamber systems including those available from Advanced Drainage Systems, Inc. under the STORMTECH® brand. Such systems are designed primarily for use under parking lots, roadways, and heavy earth loads.

STORMTECH® chambers are thermoplastic, injection molded, and formed of polypropylene, polyethylene, or a combination thereof. Such a chamber has an arched cross-section, and is formed to have a long, narrow configuration with an advantageously compact footprint that optimizes use of space. The arch-shaped chamber defines an open bottom. The chamber is installed and placed on crushed stone or other porous medium, which constitutes a floor of the chamber underlying the arch. The chamber may be formed to include corrugations, which may be advantageously shaped and configured to accommodate efficient stormwater or fluid run-off management and debris collection. One or more chambers include an inlet configured to connect to a stormwater collection system, which may include one or more drain basins that receive fluid run-off from a parking lot, roof, or street. The one or more chambers are designed to distribute collected stormwater into the ground.

During a storm, stormwater or rainwater run-off enters the chamber from the one or more drain basins, and in some system configurations, may exit the chamber by flowing through a conduit connecting the chamber to another system component, such as a basin or another chamber. By way of example, a chamber-type stormwater management system may include an array of chambers buried in crushed stone. The chambers may be connected in parallel or in series.

Stormwater carries debris and solid contaminants that can pass into and through basins, traps, and filters of conventional stormwater management systems. Stormwater may include suspended solids, including dirt, sand, organic debris such as leaves, paper, and plastic. Stormwater management system chambers such as the STORMTECH® chambers are configured to receive stormwater and allow debris to settle to a bottom of the chamber before the stormwater is released into the ground.

Related stormwater management systems known in the art have been developed that prevent some debris and solid contaminants from reaching the chambers. For example, some chamber-type stormwater management systems are configured to divert surface stormwater to a solids retention system, and then into the array of chambers so that an amount of debris and solid contaminants that enter the one or chambers connected to the system is minimized. Solids suspended or entrained in the stormwater are retained by the solids retention system using a combination of settling and filtering actions. When stormwater inflow exceeds a capacity of the solids retention system, the water rises in the diverter to an overflow point at which water flows through a bypass line to the chamber array. Such systems are disclosed in U.S. Pat. No. 6,991,734 to Smith et al., titled Solids retention in stormwater system, the entire disclosure of which is hereby incorporated by reference herein.

In another example, related stormwater management systems known in the art may include a subsystem by which stormwater first flows to a primary row of chambers dedicated to capturing a large amount of debris. The primary chamber is called an isolator row in a stormwater management system provided by Advanced Drainage Systems, Inc. The isolator row chamber is encased in a geotextile mesh or filter fabric forming a fine mesh made of any suitable now known or later developed material. Other chambers in the system may also be encased in a geotextile mesh or filter fabric forming a fine mesh made of any suitable material. The filter fabric encases the chamber, interposing the chamber and the crushed stone floor. Debris and solid contaminants have been found to locally mask and block exit points in the filter fabric, impeding outflow of fluid or water from the chamber into the ground.

Accordingly, maintenance is required to ensure optimal functionality of chambers, whether they are isolator row chambers, other chambers in an isolator row system, chambers in a system without an isolator row, or chambers in systems with or without other means of debris and solid contaminant collection. Debris is typically manually removed from an interior of a chamber using a device configured to jet water into and through an interior of the chamber to force debris and fluid out of the chamber for collection by vacuum. In particular, jetvac systems use a high pressure water nozzle to propel water through a length of a chamber to suspend and remove sediment. The high pressure spray from the nozzle causes the sediment to exit the chamber into, for example, a connected basin wherein the collected sediment is collected by vacuuming. The jetvac system and similar cleaning devices can snag, tear, or otherwise disrupt the filter fabric material, damaging an efficacy and functionality of the chamber. Accordingly, systems have been designed to protect a floor of the chamber. For example, some systems include a multi-layer mat as an additional component used to protect the filter fabric material during a cleaning and maintenance process.

Related chambers known in the art and used in chamber-type stormwater management systems such as those available from Advanced Drainage Systems, Inc., under the STORMTECH® brand, include end caps that attach to, and form a closed end of, the chambers. The ends of the chambers are capped to prevent entry of gravel, earth, or other particulates that would disrupt the filter and drainage functionality of the chamber. The chamber end cap may be formed to include a conduit or pipe stub extending therethrough and defining a channel connecting an interior of the chamber to an exterior thereof. An example end cap and chamber configuration is disclosed by U.S. Pat. No. 7,237,981 to Vitarelli, titled End cap having integral pipe stub for use with stormwater chamber, the entire disclosure of which is hereby incorporated herein by reference.

Vitarelli discloses a detachable end cap for a molded plastic stormwater chamber with an integrally welded pipe stub. The stub cantilevers outwardly from an exterior surface of the end cap for connection to a line that carries fluid to or from the chamber. The end cap may be formed of polyethylene, for example, for use with a polypropylene chamber.

Vitarelli discloses an end cap having a convex exterior or dome shaped, which is preferred over planar or flat end caps. Vitarelli discloses ensuring proper fit of the dome shaped end cap to a chamber using flared or flange portions mating with an end of the chamber to close off the chamber and prevent entry of undesired matter.

SUMMARY

A need has been recognized for further enhancing ease of chamber maintenance in chamber-type stormwater management systems. A need has been recognized for a method and configuration that enhances chamber cleaning efficacy to ensure that an interior of chambers is clear of debris that blocks outflow and downward dispersion of fluid from the chamber. It has been found that debris becomes lodged and packed on the back or interior side of the dome shaped, flared end cap. The debris is not easily removed using conventional maintenance techniques including jetting and vacuuming. Additionally, nozzles and other components of jetting and cleaning devices have been found to become lodged and caught on an interior side of the end cap when being extracted from the chamber through a chamber outlet or pipe stub attached to the end cap. Solutions are disclosed including systems, apparatus, and methods that allow the debris to be removed from the chamber during jetting, and prevent debris from collecting on an interior surface side of an end cap of the chamber.

In an embodiment, a ramp apparatus may be provided that is attachable to an interior surface of an end cap of a chamber of a stormwater management system. In this configuration, fluid and solid materials may exit an interior of the chamber by traversing the ramp and passing through an exit defined by the end cap of the chamber. In an embodiment, the ramp may be attached to the end cap interior surface and left in place during chamber operation. The ramp may be configured to have a shape, form, and profile that is non-obtrusive and does not significantly impede or diminish chamber function. Rather, the ramp may be configured to improve chamber function over time by enhancing outflow of solid debris that would otherwise collect at an end of the chamber and block fluid outflow and inflow during operation, and prevent outflow of fluid and solids during maintenance. In an alternative embodiment, the ramp may be configured for retrofitting on an interior of, for example, removable end caps. Time savings and costs savings are achieved by preventing clogs in inlets of chambers and achieving substantially complete removal of debris contained therein.

An embodiment may include a ramp useful for chamber-type stormwater management systems, and the ramp may include an inclined surface including a first end and a second end. The ramp may be configured to connect to a chamber end cap having a stub pipe centrally disposed therethrough. The ramp may be connected to the stub pipe at the second end of the ramp, a ramp surface inclined to form a slope rising from the first end to the second end. In an embodiment, the apparatus may include support feet. The support feet may be directly connected to the first end of the ramp to provide support to the first end while the second end may be supported by the stub pipe to which the ramp is attached or fitted. In an embodiment, a width of the support feet may extend equal to or beyond a width of a bottom of a chamber to which the chamber end cap is fixed.

In an embodiment, a ramp and end cap system may include a ramp having an inclined surface. The ramp may include a first end and a second end configured to connect to a chamber end cap. The chamber end cap may be configured for use in a chamber-type stormwater management system. The chamber end cap has an interior surface to which the ramp may be connected, either directly, or by way of a stub pipe passing through the end cap. An interior surface of the end cap faces an interior of a chamber enclosure formed by the end cap when connected to a chamber. In an embodiment of a ramp and end cap system, the ramp may include support feet disposed a first end thereof. A ramp surface inclines from the first end to a second end, which may be connected to the end cap, for example, at a stub pipe attached thereto. In an embodiment, a stub pipe may be formed to have a cylindrical shape. The stub pipe has a first end and a second end. The second end may be configured to extend within a chamber enclosure formed by a chamber connected to the end cap. In an embodiment, the ramp may be configured to conform to a shape of the stub pipe. In an embodiment, the ramp may be fitted directly to the stub pipe, and may be configured to form-fit to a portion of the periphery of the stub pipe. In an embodiment, the ramp may be configured to conform to a periphery at the first end of the stub pipe. In an embodiment, the ramp may include a width that is less than a width of a bottom of a chamber to which an end cap connected to the ramp is attached. In an embodiment, the ramp may be formed of polypropylene. In another embodiment, the ramp may be formed of high density polyethylene. In another embodiment, the ramp may be formed of a material selected from the group including steel, stainless steel, aluminum, and fiberglass.

In an embodiment, a process useful for forming a ramp and chamber end cap system includes providing a ramp having a first end and a second end, and a ramp surface configured to incline from the first end to the second end, the ramp surface formed to enhance flowability of fluid and passage of debris, the ramp configured to connect to a chamber end cap of a chamber-type stormwater management system. In an embodiment, methods include providing a chamber end cap including a stub pipe; and attaching or fitting the ramp to a chamber end cap. In an embodiment, methods may include providing a chamber useful for stormwater management systems; and attaching the ramp and end cap system to the chamber. In an embodiment, methods include providing a support member attached to or extending from the ramp, the support member configured to support the ramp in operation.

In another embodiment, a stormwater management system for containing and filtering runoff may be provided. The stormwater management system may include at least one stormwater chamber configured for placement underground. The stormwater chamber may be configured to store runoff and may extend between a first end cap with at least one opening and a second end cap. The stormwater chamber may include at least one of an open-bottom chamber having a side wall with an arch-shaped, round, elliptical, or polygonal cross-section, or a cylindrical, corrugated pipe. The stormwater management system may also include a flared end ramp configured to receive runoff through the at least one opening in the first end cap to guide the runoff into the stormwater chamber. An outlet end of the flared end ramp may be configured to distribute sediment across a width of the stormwater chamber. The stormwater management system may also include a filtration fabric configured to be situated beneath at least a portion of the open bottom of the stormwater chamber. The filtration fabric may be configured to capture sediment from the runoff in the stormwater chamber while the runoff flows out of the stormwater chamber.

In a further embodiment, a stormwater management system for containing and filtering runoff may be provided. The stormwater management system may include an inlet apparatus configured to receive runoff from a surface-level drain. The inlet apparatus may include at least one of an elevated bypass manifold or an overflow weir. The stormwater management system may also include a first stormwater chamber configured for placement underground to store runoff, the first stormwater chamber extending between a first end cap with at least one opening and a second end cap. The first stormwater chamber may include at least one of an open-bottom chamber having a side wall with an arch-shaped, round, elliptical, or polygonal cross-section, or a cylindrical, corrugated pipe. The stormwater management system may also include a flared end ramp configured to receive the runoff through the at least one opening in the first end cap of the first stormwater chamber to guide the runoff into the first stormwater chamber. An outlet end of the flared end ramp may be configured to distribute sediment across a width of the first stormwater chamber. The stormwater management system may also include an inlet pipe configured to extend between, and to fluidly connect, the inlet apparatus with an inlet end of the flared end ramp. The stormwater management system may also include a filtration fabric configured to be situated beneath at least a portion of the open bottom of the first stormwater chamber. The filtration fabric may be configured to capture sediment from the runoff in the first stormwater chamber while the runoff flows out of the first stormwater chamber. The stormwater management system may also include a non-woven geotextile fabric configured to cover the first end cap and at least a portion of an exterior surface of the first stormwater chamber. The stormwater management system may also include at least one additional stormwater chamber arranged side-by-side with the first stormwater chamber to form an array of stormwater chambers. The array of stormwater chambers may be fluidly connected via the inlet apparatus and may be configured to receive the runoff from the inlet apparatus and to disperse filtered runoff into at least one of the earth or an underground drainage structure.

In yet another embodiment, a flared end ramp for managing flow of material into a stormwater chamber may be provided. The flared end ramp may include an inlet end configured for connection with a pipe, a side wall of the flared end ramp having a rounded profile at the inlet end. The flared end ramp may also include an outlet end configured for placement within the stormwater chamber. The flared end ramp may also include an inclined surface extending between the inlet end and the outlet end of the flared end ramp and configured to deliver material from the pipe into the stormwater chamber. The outlet end of the flared end ramp may have a larger width than the inlet end of the flared end ramp such that the inclined surface is angled laterally outward from the inlet end toward the outlet end. The stormwater chamber may be an open-bottom chamber or a cylindrical pipe.

In a further embodiment, a flared end ramp and end cap apparatus for a stormwater chamber may be provided. The apparatus may include a flared end ramp having an inlet end configured for connection with a pipe, an outlet end configured for placement within the stormwater chamber, and an inclined surface extending between the inlet end of the flared end ramp and the outlet end of the flared end ramp. The inclined surface may be configured to deliver material from the pipe into the stormwater chamber. The apparatus may also include a stormwater chamber end cap having an interior surface configured to delimit a chamber enclosure formed by the stormwater chamber and the end cap. The stormwater chamber may be an open-bottom chamber or a cylindrical pipe.

Additional features and advantages of the disclosed embodiments will be set forth in part in the description that follows, and in part will be obvious from the description, or may be learned by practice of the disclosed embodiments. The features and advantages of the disclosed embodiments will be realized and attained by the elements and combinations particularly pointed out in the appended claims.

It is to be understood that both the foregoing general description and the following detailed description are examples and explanatory only and are not restrictive of the disclosed embodiments as claimed.

The accompanying drawings constitute a part of this specification. The drawings illustrate several embodiments of the present disclosure and, together with the description, serve to explain the principles of the disclosed embodiments as set forth in the accompanying claims.

DETAILED DESCRIPTION

Figure 1:
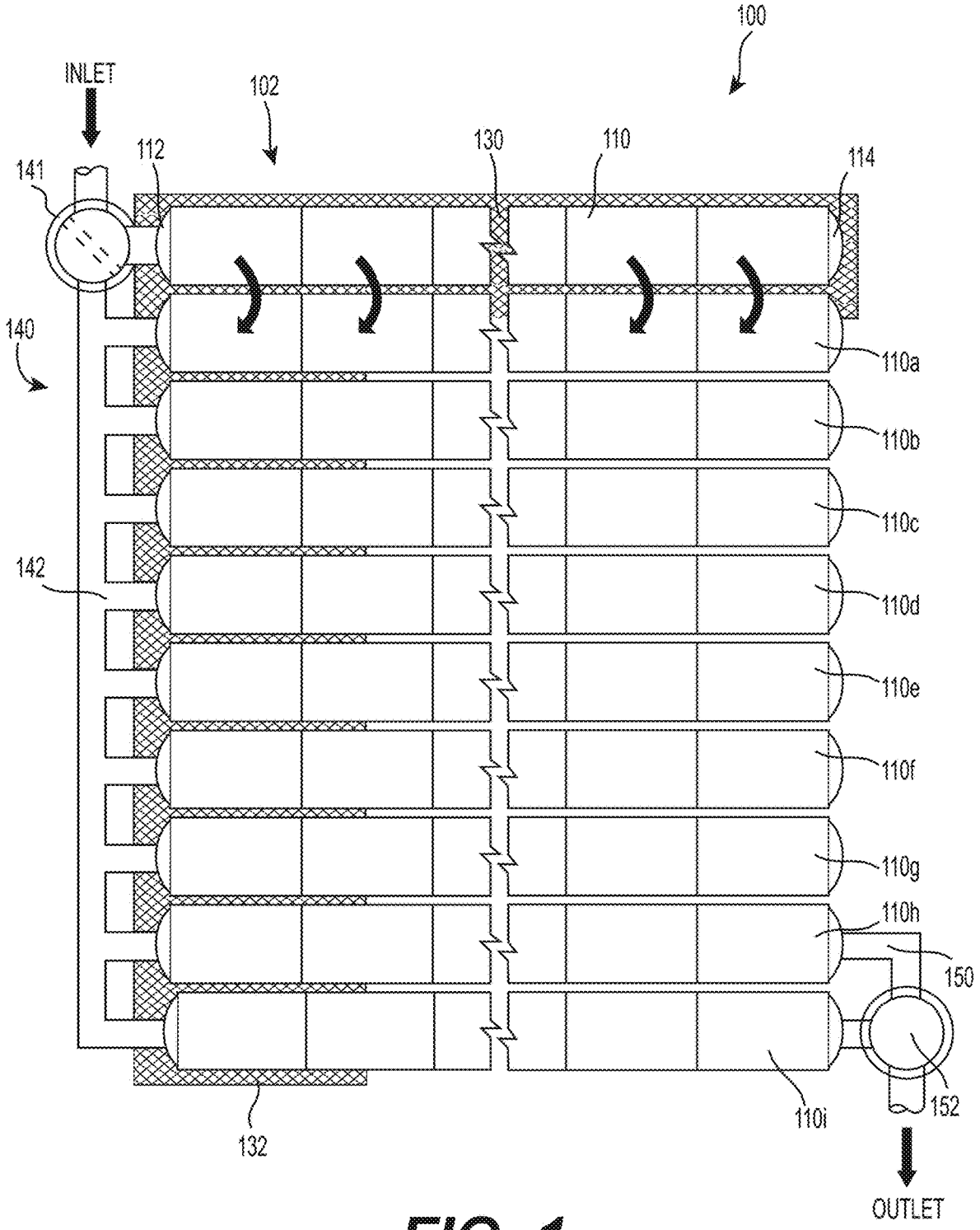
FIG. 1 depicts a schematic of an exemplary stormwater management system, consistent with various embodiments of the present disclosure.

Exemplary embodiments are described with reference to the accompanying drawings. In the figures, which are not necessarily drawn to scale, the left-most digit(s) of a reference number identifies the figure in which the reference number first appears. Wherever convenient, the same reference numbers are used throughout the drawings to refer to the same or like parts. While examples and features of disclosed principles are described herein, modifications, adaptations, and other implementations are possible without departing from the spirit and scope of the disclosed embodiments. Also, the words "comprising," "having," "containing," and "including," and other similar forms are intended to be equivalent in meaning and be open ended in that an item or items following any one of these words is not meant to be an exhaustive listing of such item or items, or meant to be limited to only the listed item or items. It should also be noted that as used in the present disclosure and in the appended claims, the singular forms "a," "an," and "the" include plural references unless the context clearly dictates otherwise.

A solution may be provided by embodiments disclosed herein to the recognized need for further enhancing ease of chamber maintenance in chamber-type stormwater management systems, for methods that enhance chamber cleaning efficacy. In particular, apparatuses and methods in accordance with embodiments of the present disclosure may enable effective cleaning of chamber-type stormwater management systems for removing cleaning equipment and sediment and debris. Solutions are disclosed that may include systems, apparatus, and methods that, inter alia, prevent debris from collecting on an interior surface side of an end cap of the chamber.

In various embodiments, a ramp apparatus may be provided that is constructed and arranged to attach to, or be placed within, a chamber useful for a chamber-type stormwater management system. In particular, the ramp may be constructed and arranged to attach to, or be placed within, an interior surface of an end cap of a chamber of a stormwater management system. In this configuration, fluid and solid materials may exit an interior of the chamber by traversing the ramp and passing through an exit defined by the end cap of the chamber. For example, the ramp may be left in place during use of the stormwater system may be available for periodic cleaning.

The ramp apparatus may be configured to improve chamber function over time, and may have a shape, form, and profile that is non-obtrusive and does not frustrate chamber function. For example, the ramp apparatus may provide an inclined surface from a ground on which the chamber is positioned to an exit passage at an end of the chamber. The ramp apparatus may be shaped to guide fluid and debris through the exit and away from the portions of the chamber interior at which debris and sediment that otherwise collects in related art systems, such as at the end cap interior around the exit of the chamber.

In various embodiments, the ramp may be configured for retrofitting on an interior of, for example, removable end caps to form a ramp and chamber end cap system. Stormwater management systems having a ramp apparatus in accordance with various embodiments may prevent clogs in inlets of chambers and enhance cleaning effectiveness and efficiency.

Figure 2:
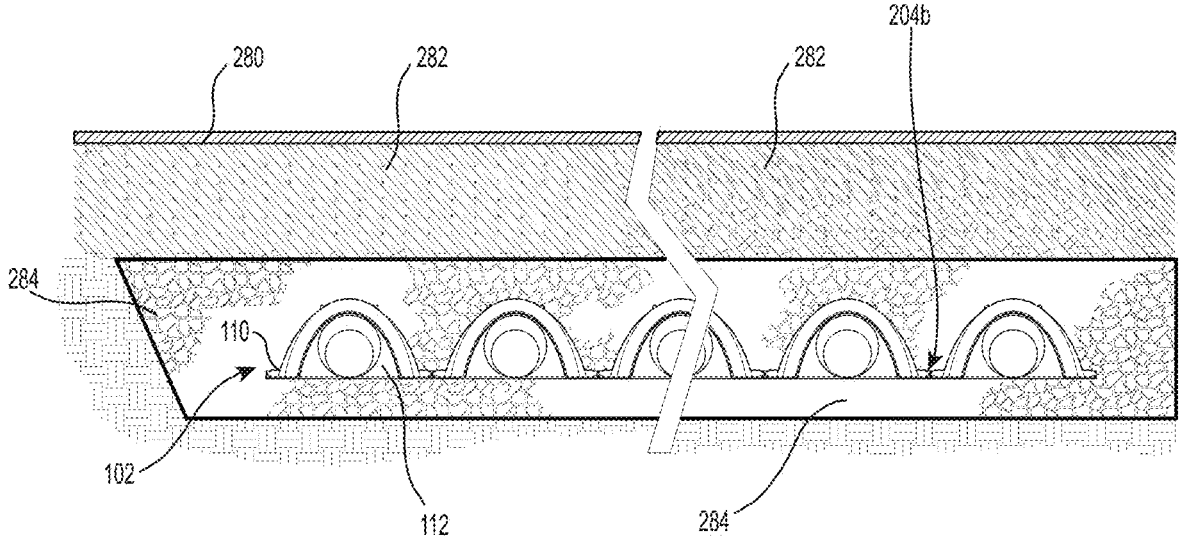
FIG. 2 depicts inlet ends of a stormwater chamber array of the stormwater management system of FIG. 1, consistent with various embodiments of the present disclosure.

FIG. 1 depicts a top plan view of an exemplary stormwater management system 100. System 100 may include an array 102 of stormwater chambers 110 arranged side-by-side in a row. FIG. 2 depicts a view of the stormwater chamber array 102 showing the inlet ends of the stormwater chambers. In the embodiment depicted in FIG. 1, array 102 may include a first stormwater chamber 110 and additional stormwater chambers 110*a*-110*i*, all of which may have similar shapes and dimensions. However, any suitable number of stormwater chambers may be utilized with system 100. Each stormwater chamber of array 102 may be an open-bottom chamber with a side wall having a round or polygonal cross-section; in various embodiments, the side wall of one or more stormwater chambers of array 102 may be perforated. The stormwater chambers of array 102 may be corrugated in various embodiments and may be constructed of plastic (e.g., polypropylene, HDPE, LDPE, PVC), metal, and/or any other suitable material. The stormwater chambers of array 102 may each include an inlet end cap 112 and an outlet end cap 114 at its two respective ends.

As shown in FIG. 2, the chamber array 102 (including the first stormwater chamber 110) may be configured for placement beneath the surface 280 of the earth (e.g., under an automobile parking lot) within a layer of water permeable media 284, which may include crushed stone, gravel, round stone, and/or slag. Fill material 282 may fill the space between the surface 280 and the top of the water permeable media 284. In some embodiments, no spacing is required between two adjacent chambers when the chamber array 102 is installed underground. Alternatively, a gap 204*b* may be provided between two adjacent chambers.

The stormwater chambers of array 102 may be configured to receive and temporarily store rainwater and other fluids (referred to herein as "runoff") from one or more surface level drains. Over time, the chambers may disperse the runoff stored therein by percolation into the surrounding water permeable media 284 through the open bottoms of the chambers. In some embodiments, one or more stormwater chambers in array 102 may be configured to provide between 10 $ft^3$ and 150 $ft^3$ of chamber storage space for receiving the runoff, although persons of ordinary skill will understand that stormwater chambers having a storage volume greater than 150 $ft^3$ or less than 10 $ft^3$ may additionally or alternatively be used with system 100.

Returning to FIG. 1, stormwater management system 100 may include a subterranean inlet apparatus 140 configured to receive the runoff from one or more surface drains, such as a combination of spaced-part catch basins interconnected by buried pipes. In some embodiments, runoff from the surface drains may flow through one or more settling devices before entering inlet apparatus 140, in order to settle out solids and floating matter. Inlet apparatus 140 may optionally include a diverter 141 configured to direct the received runoff into the first stormwater chamber 110 in the chamber array 102. As discussed below, a single layer filtration fabric 130 may be placed beneath the open-bottom of the stormwater chamber 110 in order to capture and filter out sediment and other media from the runoff as the runoff flows out of the chamber. In various embodiments, filtration fabric 130 may be formed from a single layer of a woven geotextile fabric, such as a woven polypropylene material. Advantageously, providing filtration fabric 130 to capture sediment may protect the water permeable media 284 surrounding the stormwater chamber from sediment accumulation, which can slow or altogether halt the percolation of the filtered runoff into the earth. Additionally, filtration fabric 130 may provide scour protection for the underlying ground, including water permeable media 284. In some embodiments, fabric 130 may cover the entire open-bottom of stormwater chamber 110; alternatively, fabric 130 may cover a portion of the open-bottom of stormwater chamber 110, such as a section adjacent to the inlet end cap 112. In some embodiments, a single continuous piece of filtration fabric 130 may extend beneath the entire stormwater chamber array 102. Alternatively, one or more chambers 110 in the array 102 may have separate pieces of filtration fabric 130.

Figure 3A:
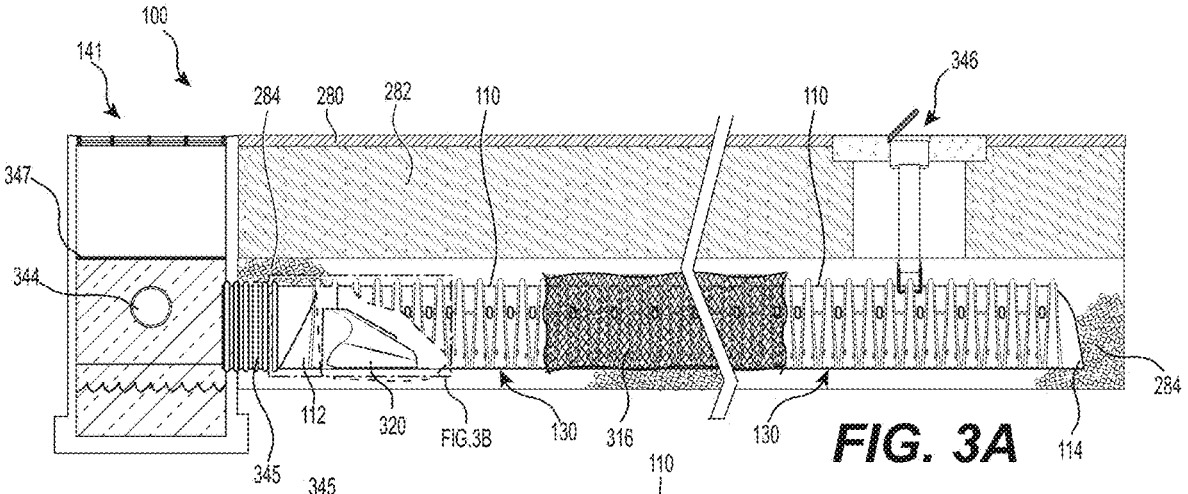
FIG. 3A depicts a side plan view of a stormwater chamber of the stormwater management system of FIG. 1, consistent with various embodiments of the present disclosure.

In some embodiments, when the first stormwater chamber 110 is full, or otherwise unable to receive additional runoff, diverter 141 may direct runoff to an inlet manifold 142 for delivery into one or more additional stormwater chambers 110*a*-110*i* of the chamber array 102. As illustrated in FIG. 3A, diverter 141 may include an elevated bypass manifold 344 and/or an overflow weir 347 that may create a differential between the first stormwater chamber 110 and the rest of the chamber array 102, thus allowing chamber 110 and filtration fabric 130 to settle and filter the received runoff. Returning to FIG. 1, at least one of the additional chambers 110*a*-110*i* may include a single layer filtration fabric 132 that is similarly configured as filtration fabric 130. In alternative embodiments, the additional chambers 110*a*-110*i* may not have a filtration fabric. Optionally, one or more stormwater chambers in array 102 may include an outflow pipe 150 configured to discharge runoff from the chambers at a predetermined rate via an outlet control structure 152 (which may include, e.g., a fluid valve). The outlet may discharge runoff to a municipal storm sewer, pond, watercourse, or other receiving point via an underground drainage structure.

In alternative embodiments, one or more cylindrical pipes may be implemented within stormwater management system 100 instead of open-bottom chamber 110. For example, array 102 may include one or more corrugated pipes configured for placement underground for drainage and transportation of runoff. Optionally, the corrugated pipes of array 102 may include perforations along some or all of their respective longitudinal lengths, which may allow the gradual percolation of runoff into the surrounding water permeable media 284. Pipes of stormwater management system 100 may be constructed of plastic (e.g., polypropylene, HDPE, LDPE, PVC), metal, and/or any other suitable material. In some embodiments, filtration fabric 130 may be placed beneath a corrugated pipe of array 102 to filter the runoff released from the pipe. Additionally, or alternatively, filtration fabric 130 may line some or all of the interior or exterior surface of a corrugated pipe of array 102, so as to filter the runoff within the pipe before the runoff is released from the pipe. However, in some embodiments, a corrugated pipe may be provided in array 102 without a corresponding filtration fabric.

Figure 3B:
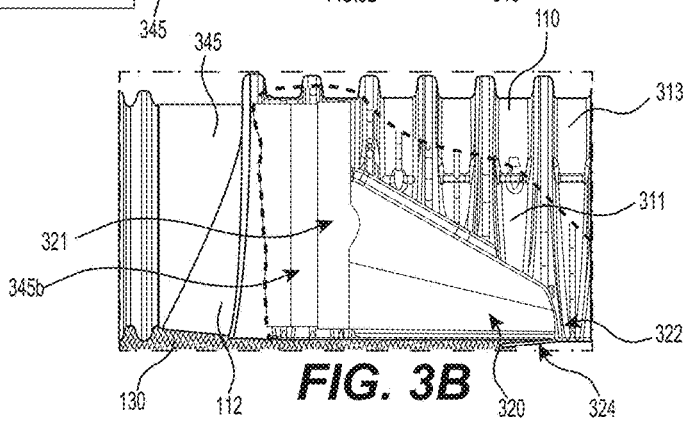
FIG. 3B depicts an enlarged view of an inlet end of the stormwater chamber of FIG. 3A, consistent with various embodiments of the present disclosure.

FIG. 3A depicts a side plan view of the first stormwater chamber 110 of stormwater management system 100. FIG. 3B depicts an enlarged view of a portion of the stormwater chamber 110 near the inlet end cap 112. As shown in FIG. 3A, a non-woven geotextile fabric 316 may cover the outer surface 313 of the stormwater chamber 110 to protect the chamber and extend its service life. For example, fabric 316 may cover the entire outer surface 313 of the chamber, including inlet end cap 112 and/or outlet end cap 114. In some embodiments, stormwater management system 100 may include an inspection port 346 allowing for inspection and maintenance of the subterraneous components of system 100.

As shown in FIGS. 3A and 3B, an inlet pipe 345 (e.g., a stub pipe) may be provided to fluidly connect the inlet apparatus 140 to the stormwater chamber 110. An interior end 345*b* of the inlet pipe may connect to a flared end ramp 320 that is positioned, at least partially, within the stormwater chamber 110 and that is angled downwards from the inlet pipe to convey the runoff away from the inlet end cap 112 and further into the chamber 110. In some embodiments, the inlet pipe 345 may extend through an opening in the inlet end cap and connect with an inlet end 321 of the flared end ramp. In these embodiments, flared end ramp 320 may be situated entirely within stormwater chamber 110. Alternatively, the inlet end 321 of the flared end ramp may be situated within the opening in the inlet end cap 112 or external to the stormwater chamber 110 (i.e., to the left of inlet end cap 112 in FIG. 3B). In such embodiments, the flared end ramp 320 may extend through an opening in the inlet end cap 112 and into the stormwater chamber 110. As discussed in detail below, the inlet end 321 of the flared end ramp may have a larger width than an outlet end 323 of the flared end ramp. As a result, the flared end ramp 320 may receive runoff from inlet pipe 345 (which may have a much smaller cross-section than chamber 110) and distribute the runoff across the width of the chamber 110. For example, the outlet end 323 of the flared end ramp may extend across the entire width of stormwater chamber 110 and may abut the chamber's inner surface 311 in some embodiments. Advantageously, this configuration may enable the flared end ramp 320 to prevent sediment in the runoff from accumulating around the inlet end cap 112 by distributing the runoff (and the sediment contained therein) away from the chamber's inlet end and across the entire width of the chamber.

Flared end ramp 320 may include at least one support foot 324 attached to a bottom portion of the ramp at or near the outlet end 322. The at least one support foot 324 may extend laterally from the flared end ramp 320 to form a wide structure configured to support the ramp. In the embodiment of FIG. 3B, filtration fabric 130 may pass beneath the flared end ramp 320 (including the at least one support foot 324), as well as the inlet end cap 112 and the interior end 345*b* of the inlet pipe. This placement may ensure that any runoff that leaks or splashes while flowing between the inlet pipe and the flared end ramp is still filtered by the fabric. Alternatively, the end of the filtration fabric 130 (i.e., the left end of fabric 130 in FIG. 3B) may be placed at any other suitable location relative to the inlet end cap 112 and flared end ramp 320.

Figure 4A:
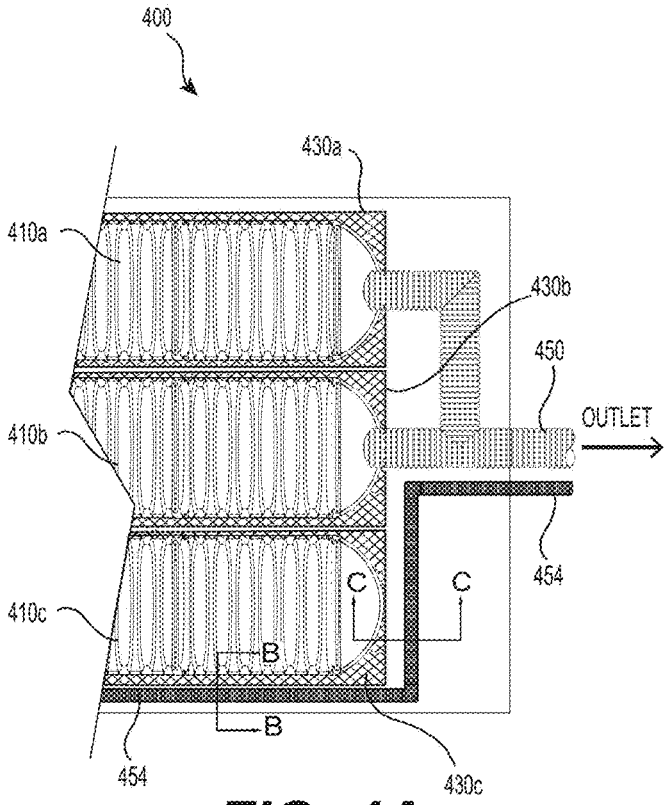
FIG. 4A depicts an exemplary underdrain for a stormwater management system, consistent with various embodiments of the present disclosure.
Figure 4B:
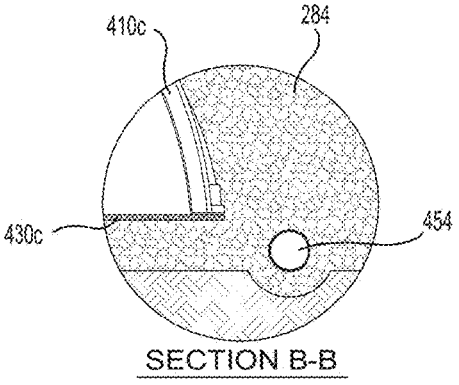
FIGS. 4B and 4C depict cross-sectional views of the exemplary underdrain as indicated in FIG. 4A, consistent with various embodiments of the present disclosure.
Figure 4C:
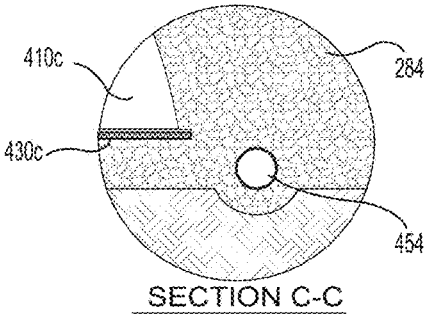

FIG. 4A depicts an underdrain 454 for an exemplary stormwater management system 400. FIGS. 4B and 4C depict cross-sectional views of different portions of the underdrain 454, as indicated in FIG. 4A. In the example of FIGS. 4A-4C, the stormwater management system may include stormwater chambers 410*a*, 410*b*, and 410*c*, each of which may have a filtration fabric 430*a*, 430*b*, and 430*c*, respectively, placed beneath it. However, persons of ordinary skill will understand that any suitable number of stormwater chambers and filtration fabrics may be employed consistent with the present disclosure. In the example shown in FIGS. 4A-4C, the filtration fabrics may be larger in area than the open-bottoms of the stormwater chambers, such that the fabrics may extend outward beyond the edges of the chambers. For example, filtration fabric 430*c* in FIG. 4B extends to the right beyond the right-most edge of chamber 410*c*. Advantageously, the large area of the filtration fabric may ensure that the entire open-bottom of the stormwater chamber is covered by the filtration fabric in order to maximize filtration of the runoff received within the chamber.

In addition to an outflow pipe 450, filtered runoff from chambers 410*a*-410*c* may be dispersed into water permeable media 284 through the open bottoms of the chambers and collected in underdrain 454 for removal to a receiving point. As shown in FIGS. 4B and 4C, underdrain 454 may be located within the layer of water permeable media 284 and beneath (i.e., at a lower position than) the stormwater chambers and filtration fabrics.

Figure 5A:
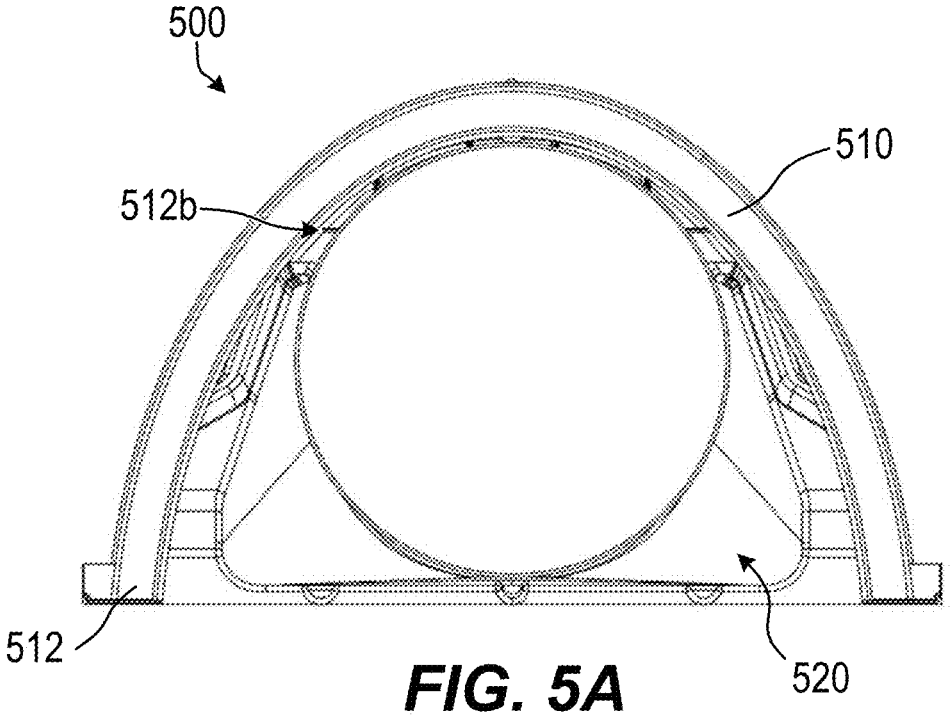
FIG. 5A depicts a plan view of an outlet end of an exemplary stormwater chamber configured with a flared end ramp, consistent with various embodiments of the present disclosure.

FIG. 5A shows a plan view of an inlet end of a stormwater chamber 510 configured with a flared end ramp 520 in accordance with various embodiments. In particular, FIG. 5A shows a stormwater management system 500, including an inlet end cap 512 and flared end ramp 520 connected to a stormwater chamber 510 configured for stormwater management. Stormwater chamber 510 may be connected to the inlet end cap 512, which may have an interior surface 512*b* facing an interior of the stormwater chamber to form an enclosure when positioned on the ground and/or when installed underground.

FIG. 5A shows an interior surface 512*b* of the inlet end cap 512. Flared end ramp 520 may be connected to the end cap interior surface 512*b* by way of a stub pipe (not shown). The stub pipe may be constructed and arranged to provide a passageway from an interior of the stormwater chamber 510 to an exterior thereof. The stormwater chamber 510 may be of any suitable size and form, and the flared end ramp 520 may be sized and shaped to a particular chamber size or form, and a particular stub pipe size and form.

The flared end ramp 520 shown in FIG. 5A shows an advantageous configuration wherein the ramp 520 inclines from a first bottom end (i.e., the outlet end) upwards toward a second top end (i.e., the inlet end), relative to a bottom of the connected stormwater chamber 510. The flared end ramp 520 may be formed to surround a portion of the periphery of the "interior" end of the stub pipe at the interior surface 512*b* of the inlet end cap. A surface of the flared end ramp 520 may be formed to facilitate effective and rapid passage of fluid and materials through the interior end of the stub pipe to enter the stormwater chamber 510.

Flared end ramp 520 may take any suitable shape and form that provides an inclined surface extending from a bottom of a chamber enclosure interior to a fluid inlet thereof formed by a stub pipe of the inlet end cap. In an embodiment, the flared end ramp 520 may be formed of polypropylene or high density polyethylene. In alternative embodiments, the ramp 520 may be formed of materials selected from the group of materials including steel, stainless steel, aluminum, fiberglass, and other like now known or later developed materials.

Flared end ramp 520 may be fastened to the stub pipe at an end thereof that directly connects to the interior of the stormwater chamber enclosure. The stub pipe may be formed by any now known or later developed methods and materials and configured for fluid delivery. The stub pipe connected to the flared end ramp 520 shown in FIG. 5A may have a cylindrical shape. The flared end ramp 520 may be fastened to the stub pipe by any now known or later developed suitable mechanisms, materials, and methods. In an alternative embodiment, the flared end ramp 520 may be attached directly to the interior surface 512*b* of the inlet end cap, or may be attached directly to both the stub pipe and the interior surface 512*b* of the inlet end cap.

Figure 5B:
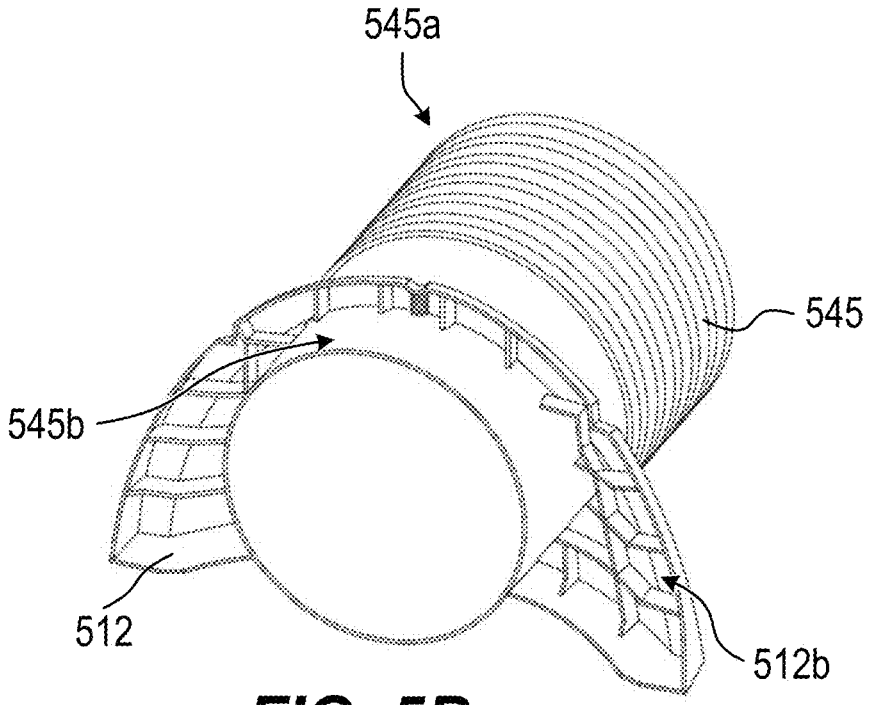
FIG. 5B depicts a perspective overhead view of an exemplary inlet end cap of the stormwater chamber of FIG. 5A, consistent with various embodiments of the present disclosure.

FIG. 5B shows a perspective overhead view of a stormwater chamber inlet end cap 512 including a stub pipe 545 extending through an opening defined in the inlet end cap. Inlet end cap 512 may be dome shaped and flared, and configured to connect to an open end of the stormwater chamber. A first end 545*a* of the stub pipe 545 extends away from an exterior side surface (not shown) of the inlet end cap, while a second end 545*b* of the stub pipe 545 extends away from the interior surface 512*b* of the inlet end cap.

Figure 5C:
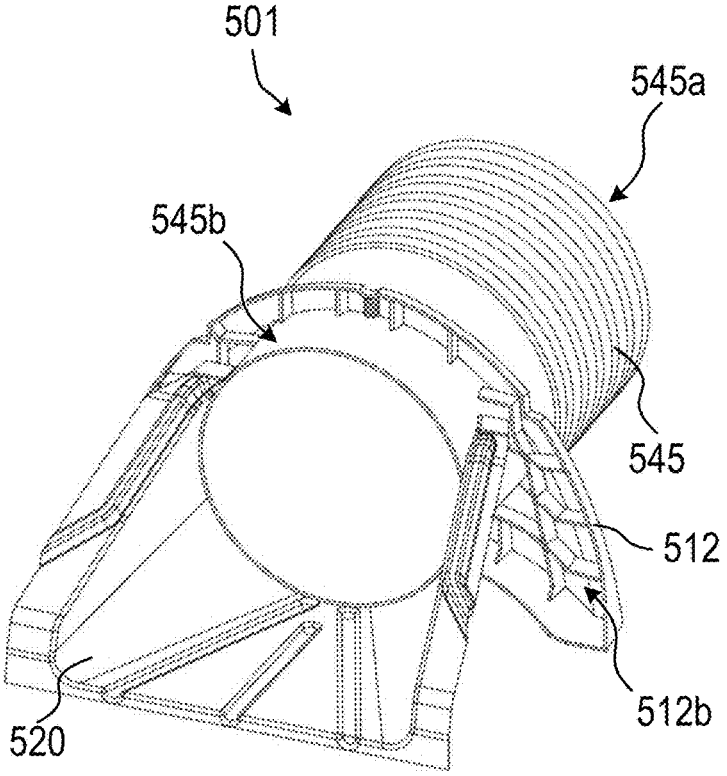
FIG. 5C depicts a perspective overhead view of the flared end ramp and inlet end cap of the stormwater chamber of FIG. 5A, consistent with various embodiments of the present disclosure.

FIG. 5C shows a perspective overhead view of a flared end ramp and stormwater chamber inlet end cap apparatus in accordance with various embodiments. In particular, FIG. 5C shows a ramp and end cap apparatus 501 including inlet end cap 512 and a flared end ramp 520 connected thereto. The flared end ramp 520 may be configured and arranged to prevent debris and solid contaminants from collecting and becoming lodged at the interior surface 512*b* of the inlet end cap. Accordingly, debris and solid contaminants may be guided up the flared end ramp 520 and through the passageway defined by the stub pipe 545 during maintenance and cleaning. Flared end ramp 520 may prevent the debris and solid contaminants from collecting at the end cap interior surface 512*b*, and may guide the debris and solid contaminants along with fluid through an exit from the interior of the stormwater chamber provided by the stub pipe 545. Additionally, a nozzle or other component of a jetvac system or another chamber maintenance device will not become lodged and caught on an interior of the end cap.

Figure 5D:
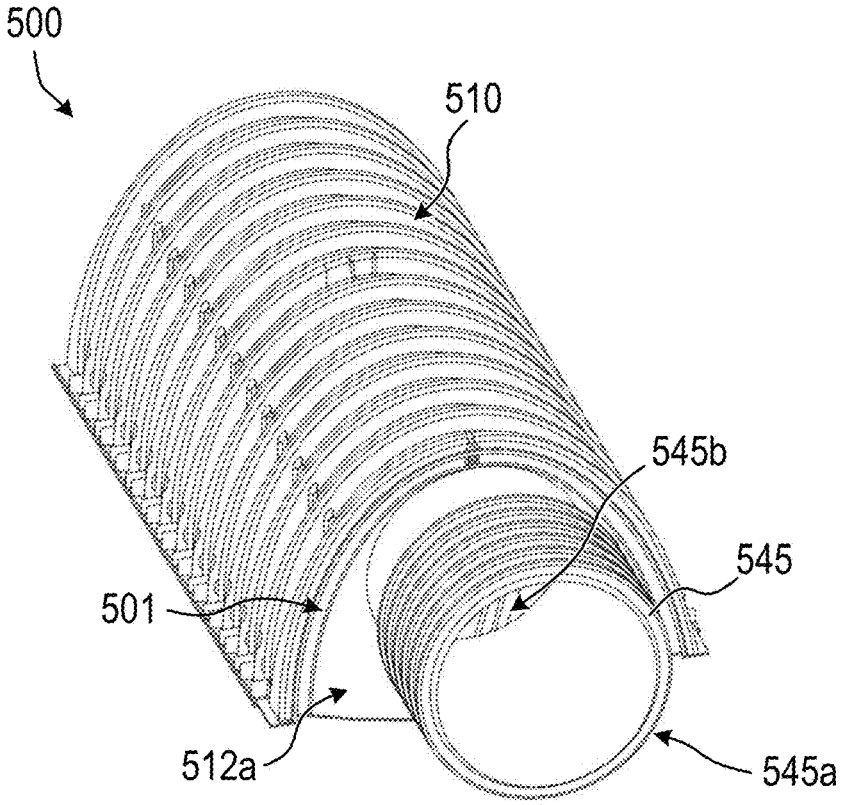
FIG. 5D depicts a perspective overhead view of the stormwater chamber of FIG. 5A, including the flared end ramp and inlet end cap of FIG. 5C, consistent with various embodiments of the present disclosure.

FIG. 5D shows a perspective overhead view of stormwater management system 500, in accordance with various embodiments. In particular, FIG. 5D shows an assembled flared end ramp, stormwater chamber, and inlet end cap system 500. Stormwater management system 500 may include a stormwater chamber 510 with the inlet end cap and flared end ramp apparatus 501 connected thereto.

FIG. 5D shows an exterior surface 512*a* of the inlet end cap, and a stub pipe 545. The stub pipe 545 may include a first end 545*a* extending from the exterior surface 512*a* of the inlet end cap. The stub pipe 545 may extend transversely through the inlet end cap, with a second, interior end 545*b* extending away from an interior surface (not shown) of the inlet end cap and communicating with a flared end ramp 520 in an interior of the stormwater chamber 510. The stub pipe 545 may be welded, for example, at the interface of the stub pipe with the inlet end cap exterior surface 512*a*.

Figure 5E:
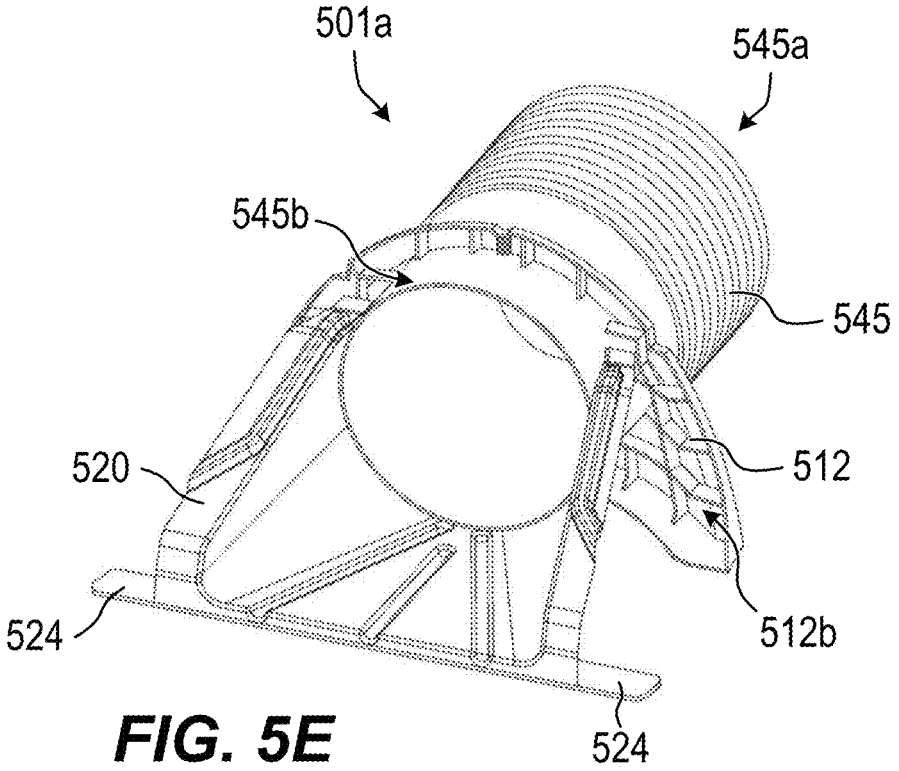
FIG. 5E depicts a perspective overhead view of another exemplary flared end ramp and inlet end cap of the stormwater chamber of FIG. 5A, consistent with various embodiments of the present disclosure.

FIG. 5E shows a perspective overhead view of a ramp and chamber end cap in accordance with various embodiments. In particular, FIG. 5E shows an alternative flared end ramp and inlet end cap apparatus 501*a*, which may be similarly configured as apparatus 501 shown in FIG. 5C. FIG. 5E shows a ramp and end cap apparatus 501*a* including an inlet end cap 512 and a flared end ramp 520 connected thereto. The flared end ramp 520 may be configured and arranged to prevent debris and solid contaminants from collecting and becoming lodged at the interior surface 512*b* of the inlet end cap. Accordingly, debris and solid contaminants are guided up the ramp and through the passageway defined by the stub pipe 545 during maintenance and cleaning. The flared end ramp 520 of the embodiment shown in FIG. 5E may include supports or feet 524.

Figure 5F:
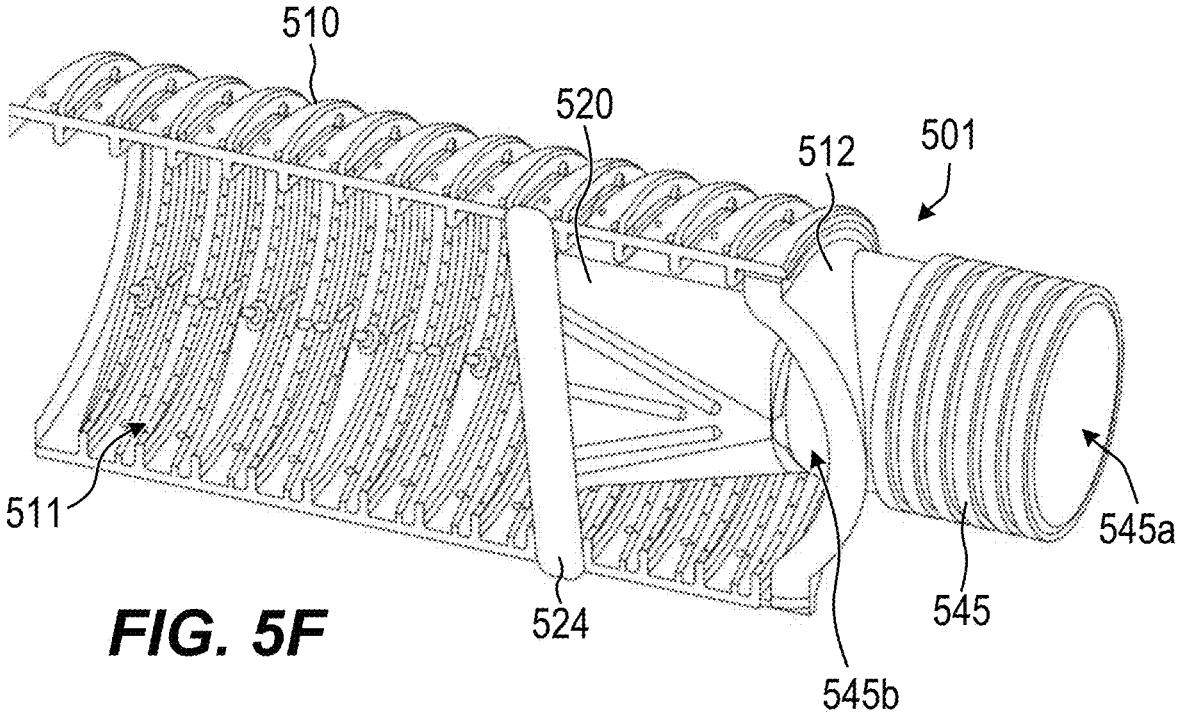
FIG. 5F depicts a perspective bottom view of the stormwater chamber of FIG. 5A, including the flared end ramp and inlet end cap of FIG. 5E, consistent with various embodiments of the present disclosure.

The supports 524 may be configured as shown in FIG. 5F to extend beyond a width of the stormwater chamber 510, and underneath bottom edges of sides of the stormwater chamber to which the ramp and end cap apparatus 501 is connected. FIG. 5F shows a stormwater management system 500 of an embodiment from a bottom perspective view.

In particular, FIG. 5F shows a ramp and end cap apparatus 501 including an inlet end cap 512 and a flared end ramp 520 connected thereto by way of a stub pipe 545. The flared end ramp 520 may be configured and arranged to prevent debris and solid contaminants from collecting and becoming lodged at the interior surface 512*b* of the inlet end cap. Accordingly, debris and solid contaminants are guided up the ramp and through the passageway defined by the stub pipe 545 during maintenance and cleaning. The flared end ramp 520 of the embodiment shown in FIG. 5F includes supports or feet 524.

FIG. 5F shows an interior surface 511 of the stormwater chamber 510. The feet 524 of the flared end ramp 520 may be configured to extend under the sides of the stormwater chamber 510. Accordingly, the flared end ramp 520 may be configured to lift relative to the ground to an extent limited by the contact between the feet 524 and the stormwater chamber walls. Additionally, or alternatively, the feet 524 may be constructed and arranged to provide support against the ground or surface upon which the fluid management system 500 rests.

Figure 6:
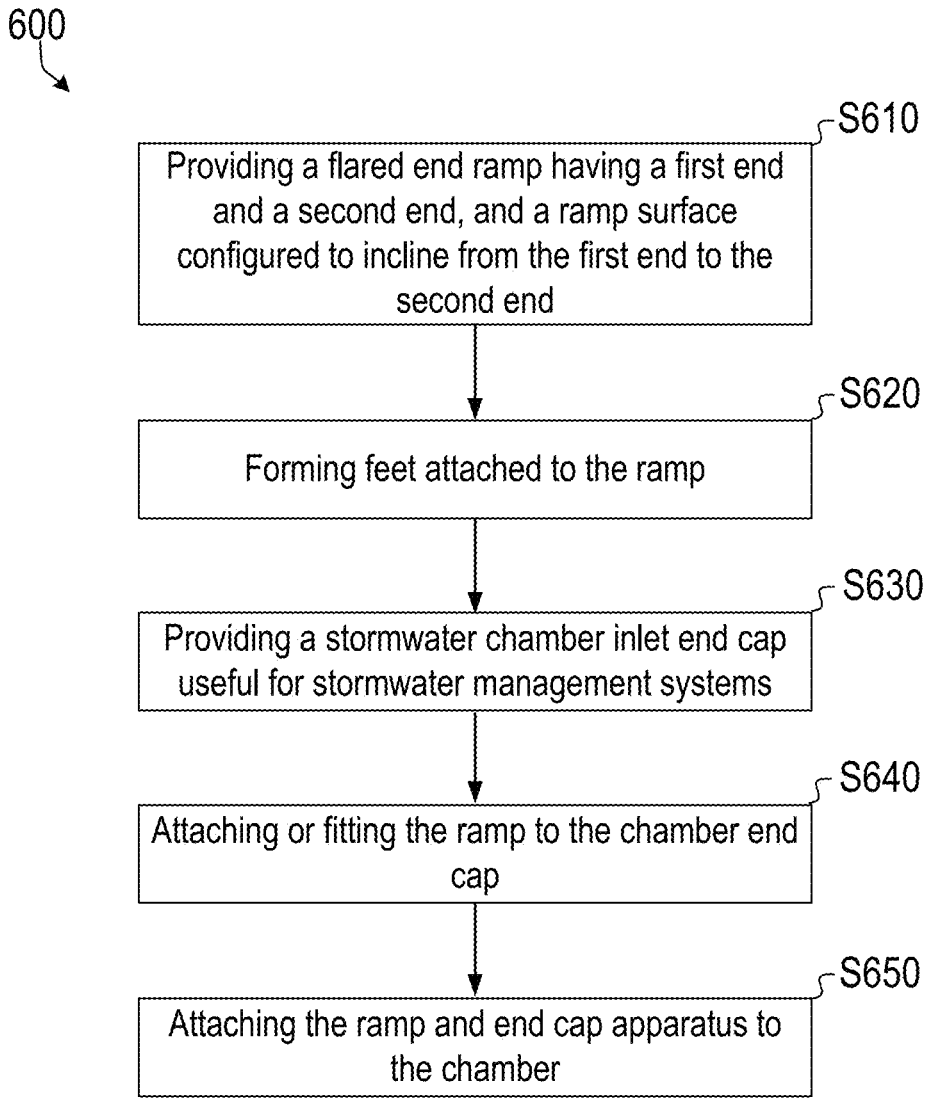
FIG. 6 depicts a flow diagram of an exemplary process for forming a flared end ramp and stormwater chamber inlet end cap system, consistent with various embodiments of the present disclosure.

FIG. 6 shows a process of forming a stormwater chamber, flared end ramp, and inlet end cap system in accordance with various embodiments. In particular, FIG. 6 shows a method 600 including a step S610 of providing a flared end ramp having a first end and a second end, and a ramp surface configured to incline from the first end to the second end. The ramp surface may be formed to enhance flowability of fluid and passage of debris. For example, the flared end ramp may include a curved surface meeting and conforming with a shape of an end of a cylindrical stub pipe connected to an inlet end cap.

FIG. 6 shows step S620 of forming feet attached to the flared end ramp. The feet may include a same material as the flared end ramp, or a different material, formed to provide a support structure configured to support the flared end ramp in operation. For example, a flared end ramp positioned in a stormwater management system may rest on a ground on which the stormwater chamber is installed. A first, lower end (i.e., an outlet end) of the inclined ramp may rest on the feet or support structure. In an embodiment, the feet may be configured to have a width equal to or larger than a width of a bottom of the stormwater chamber. The feet may be configured to be positioned beneath the stormwater chamber wall for additional support. Thus, structural distortion caused by movement of the flared end ramp connected to the stormwater chamber during operation may be minimized.

Methods including a step S630 of providing an inlet end cap useful for stormwater management systems. The inlet end cap may include a stub pipe passing through a central portion of the inlet end cap. Methods include a step S640 of attaching or fitting the flared end ramp to the inlet end cap. The flared end ramp has a first end, a second end, and a ramp surface inclined from the first end to the second toward the pipe stub when connected thereto.

The flared end ramp may be configured and arranged to prevent debris and solid contaminants from collecting and becoming lodged at the interior surface of the inlet end cap. In an embodiment, the flared end ramp may be connected to an interior surface of the inlet end cap. In another embodiment, the flared end ramp may be connected to the inlet end cap by way of a third member, for example, attached or fitted to a stub pipe to which the inlet end cap is attached.

The chamber end cap may be configured to attach to the stormwater chamber and form a chamber enclosure. In an embodiment, the end cap may be welded to the stormwater chamber. FIG. 6 shows a step S650 of attaching the flared end ramp and end cap apparatus to the stormwater chamber. The flared end ramp and end cap apparatus is configured to connect to the stormwater chamber to form an enclosure containing the flared end ramp. A bottom of the flared end ramp is in facing relation to a ground on which the stormwater chamber is placed. A top surface of the ramp surface is in facing relation to an interior top surface of the stormwater chamber. The ramp surface may be curved or otherwise shaped and fitted to the stub pipe to form a smooth, inclined transition from a chamber interior into a stub pipe, the bottom of which is located above a bottom or lower portion of the stormwater chamber.

Figure 7A:
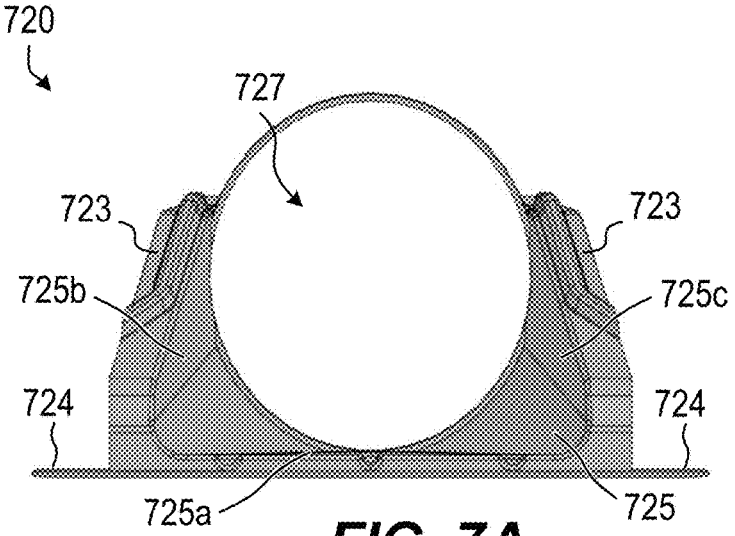
FIGS. 7A-7E depict another exemplary flared end ramp, consistent with various embodiments of the present disclosure.
Figure 7B:
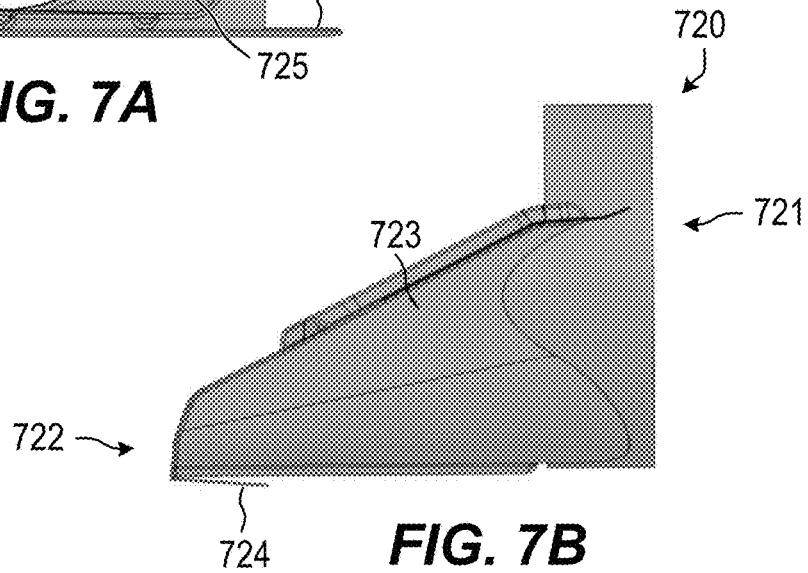
Figure 7C:
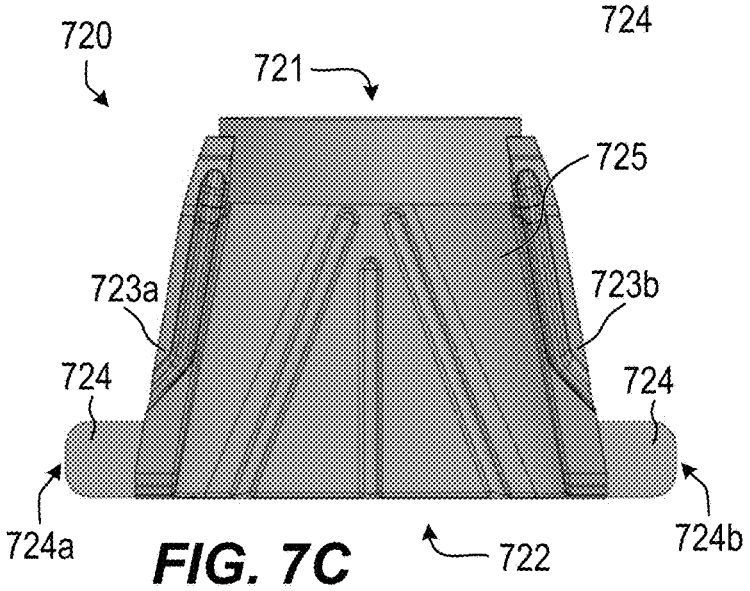
Figure 7D:
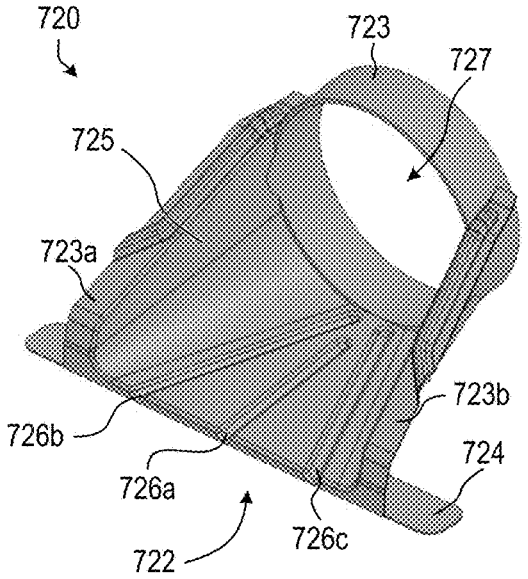
Figure 7E:
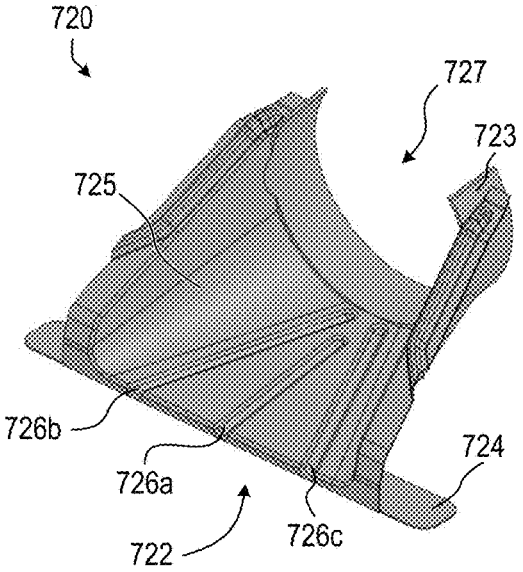

FIGS. 7A-7E illustrate another exemplary flared end ramp 720 configured for use in a stormwater management system. For example, flared end ramp 720 may be configured to manage flow of material, such as runoff, into a stormwater chamber. Flared end ramp 720 may include an inlet end 721 configured to receive runoff from an inlet pipe. In some embodiments, ramp side wall 723 may have a rounded profile at the inlet end 721 to form an inlet opening 727. For example, FIG. 7D illustrates an embodiment in which side wall 723 has an annular profile at inlet end 721 to form the inlet opening, and FIG. 7E illustrates an alternative embodiment in which side wall 723 has a semi-circular profile at inlet end 721 to form the inlet opening. An end of an inlet pipe may be received within the inlet opening 727, which may conform to the end of the inlet pipe to form a fluid-tight connection. Additionally, or alternatively, the inlet pipe and flared end ramp 720 may be connected via one or more fixation means, such as welding, adhesive, and/or a mechanical connector.

In some embodiments, the diameter of inlet opening 727 of the flared end ramp may be designed to receive an inlet pipe having a known outer diameter, such that the inlet pipe may fit securely within the inlet opening 727. In some embodiments, inlet opening 727 of the flared end ramp may have a diameter of between 6.0 inches and 60.0 inches. For example, inlet opening 727 may have a diameter of approximately 18 inches to receive an inlet pipe with an 18-inch diameter, or a diameter of approximately 24 inches to receive an inlet pipe with a 24-inch diameter.

Flared end ramp 720 may also include an outlet end 722 at an opposite end of the ramp from the inlet end 721, and an inclined surface 725 extending between the inlet end 721 and outlet end 722. As shown in FIG. 7A, inclined surface 725 may have a rounded profile near the inlet end 721, similar to the profile of the inlet opening 727. The inclined surface 725 may have a different profile at the outlet end 722, including a flattened bottom portion 725*a* and first and second upstanding side portions 725*b*, 725*c*. In some embodiments, outlet end 722 may have a larger width than inlet end 721; specifically, inclined surface 725 may have a greater width at the outlet end 722 and a smaller width at the inlet end 721. As a result, ramp side walls 723 may be angled laterally outward (i.e., may extend away from the center of the inclined surface 725) from the inlet end 721 toward the outlet end 722.

Flared end ramp 720 may include at least one support foot 724 configured to support the flared end ramp on a support surface. As shown in FIG. 7B, the at least one support foot 724 may be connected to a bottom surface of the flared end ramp at, or in close proximity to, the outlet end 722 by known methods such as welding, adhesive, and/or a mechanical connector. In the embodiments depicted in FIGS. 7A-7E, the flared end ramp may include a single support foot 724 extending laterally, and continuously, between the side walls 723*a* and 723*b* at the outlet end of the ramp. In alternative embodiments, the flared end ramp may include at least two support feet, a first of which may extend laterally from first side wall 723*a* and a second of which may extend laterally from second side wall 723*b*. As shown in FIG. 7C, the at least one support foot 724 extends laterally from the side walls of the flared end ramp. As a result, a distance between support foot edges 724*a* and 724*b* may form the widest portion of the flared end ramp 720.

As shown in FIGS. 7D and 7E, flared end ramp 720 may include one or more drainage grooves formed in the inclined surface 725 to promote flow of runoff from the inlet end 721 towards the outlet end 722. For example, the ramp may include a drainage groove 726*a* extending along the center or midline of the inclined surface 725. Additionally, or alternatively, the ramp may include one or more drainage grooves originating near the center of the inclined surface at the inlet end 721, and extending laterally outward towards the outlet end 722. For example, the flared end ramp may include drainage grooves 726*b* and 726*c* extending from the center of the inclined surface 725 near the inlet end of the ramp towards the first side wall 723*a* and the second side wall 723*b*, respectively, at the outlet end of the ramp. Advantageously, drainage groove 726*a* may promote runoff flow along a midline of the ramp and into the center of the stormwater chamber, while drainage grooves 726*b* and 726*c* may guide runoff away from the center of the stormwater chamber and towards the chamber side walls.

Figure 8A:
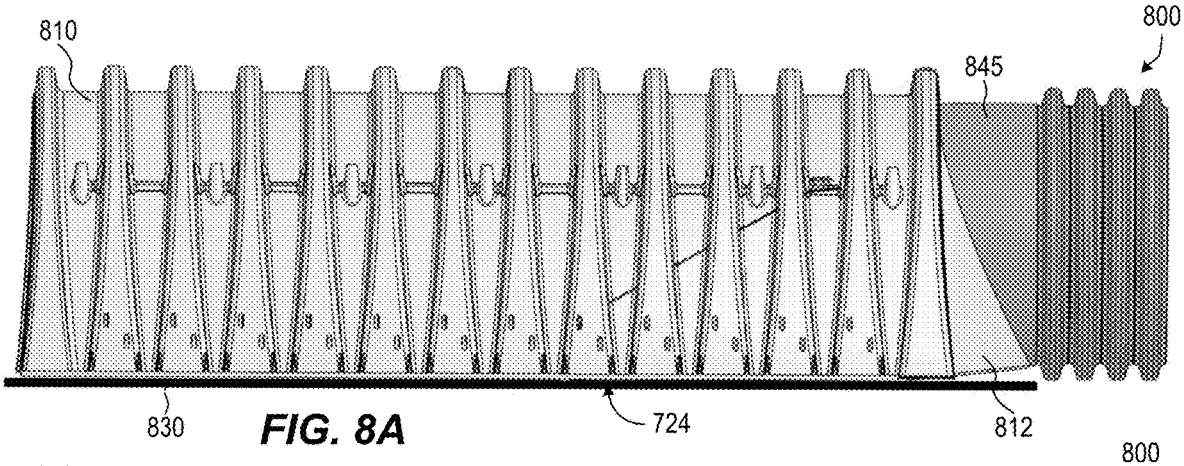
FIG. 8A depicts another exemplary stormwater management system with the flared end ramp of FIGS. 7A-7E, consistent with various embodiments of the present disclosure.
Figure 8B:
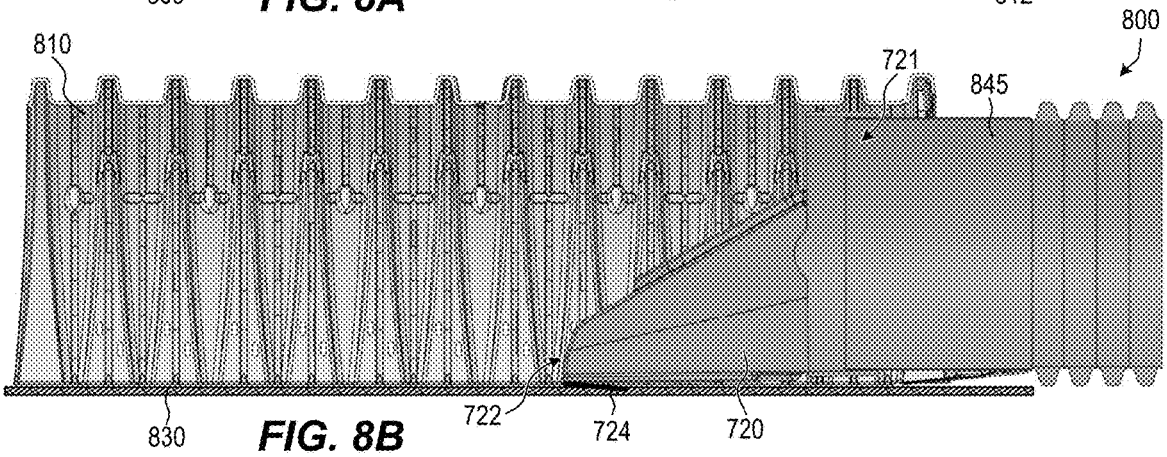
FIG. 8B depicts an interior view of the stormwater management system of FIG. 8A, consistent with various embodiments of the present disclosure.

FIG. 8A illustrates an exterior view of another exemplary stormwater management system 800, which may include the flared end ramp 720. FIG. 8B illustrates an interior view of stormwater management system 800. Stormwater management system 800 may have a similar configuration as systems 100, 400, and 500 discussed herein, and may include a stormwater chamber 810 with an inlet end cap 812, an inlet pipe 845 configured to convey runoff from an inlet apparatus (not shown) to flared end ramp 720, and a filtration fabric 830 covering the open-bottom of stormwater chamber 810 to filter runoff percolating from the chamber into the earth. In the embodiment shown in FIGS. 8A and 8B, inlet pipe 845 may pass through the inlet end cap 812 and into the stormwater chamber 810, where the inlet pipe may connect with the inlet end 721 of the flared end ramp; accordingly, flared end ramp 720 may be wholly contained within stormwater chamber 810. Alternatively, inlet end 721 of the flared end ramp may be situated within the opening formed in the inlet end cap 812 or at a location outside of the stormwater chamber. In such embodiments, the flared end ramp 720 may pass through the opening in the inlet end cap and into the stormwater chamber.

Flared end ramp 720 may be configured to convey runoff away from the inlet end cap 812 and further into the stormwater chamber 810. In some embodiments, the outlet end 722 of the flared end ramp may rest on the filtration fabric 830 and may have a large width, relative to the inlet end 721, such that the flared end ramp may distribute sediment across the width of the stormwater chamber. In some embodiments, flared end ramp 720 may include at least one support foot 724 having a larger width than the stormwater chamber 810; this may cause the at least one support foot 724 to extend out of the stormwater chamber 810 through the open-bottom of the chamber, as shown in FIG. 8A. Advantageously, the contact between the at least one support foot 724 and the bottom edge of the stormwater chamber 810 may secure the flared end ramp and stormwater chamber together against relative movement.

In some embodiments, the at least one support foot 724 may have a small height (i.e., the vertical dimension in FIGS. 8A and 8B), such as a height of less than one inch. For example, the at least one support foot 724 may have a height of approximately 0.25 inches. Advantageously, the small height of the support foot 724 allows the outlet end of the inclined surface 725 to rest on the bottom of the stormwater chamber (i.e., on the filtration fabric 830), allowing smooth, non-turbulent flow of runoff from the flared end ramp 720 into the stormwater chamber 810 and allowing sediment in the runoff to settle more quickly for faster filtration.

Additionally, or alternatively, the at least one support foot 724 may have a width (i.e., the distance between support foot edges 724*a* and 724*b*) that is equal to or larger than the width of the stormwater chamber 810. This may allow the support foot to engage the bottom edge of the chamber to secure the ramp and chamber together. In some embodiments, the at least one support foot 724 may have a width of between 25.0 inches and 125.0 inches, such as a width of approximately 50 inches, 78 inches, or 100 inches.

In the embodiment shown in FIGS. 8A and 8B, inlet pipe 845 may pass through an opening in inlet end cap 812 such that flared end ramp 720 is not in contact with the inlet end cap. For example, a distance of between 0.5 and 3.0 inches (e.g., a distance of between 1.0 and 2.0 inches) may be provided between inlet end cap 812 and flared end ramp 720. Inlet pipe 845 may be secured to inlet end cap 812, such as by welding. Additionally, or alternatively, inlet pipe 845 may be secured to the flared end ramp 720, such as by welding the inlet opening 727 of the ramp directly to an outer surface of the inlet pipe or by a mechanical connector (e.g., a threaded rod and nut).

In various embodiments, filtration fabric 130, 430, 830 (referred to hereafter as filtration fabric 130) may be formed from a single layer of a woven geotextile fabric, such as a woven polypropylene material. Advantageously, implementing filtration fabric 130 with stormwater management system 100 has been found to increase the filtration rate of runoff that is stored in the stormwater chamber, while also providing high rates of sedimental removal efficency. For example, material properties of an exemplary filtration fabric 130 and prior filtration fabric SKAPS SW315 (referred to hereafter as "SW315," which is a woven geotextile having two layers) were tested by the Applicant to evaluate the suitability of each fabric for use with the exemplary stormwater management system 100. The properties of both fabrics are provided below:

| Property | Filtration Fabric 130 (MARV[1]) | SW315 Fabric (MARV[1]) |
|---|---|---|
| Grab Tensile Strength | 325 lbs. | 315 lbs. |
| Grab Elongation | 15% | 15% |

-continued

| Property | Filtration Fabric 130 (MARV[1]) | SW315 Fabric (MARV[1]) |
|---|---|---|
| CBR Puncture Resistance | 1124 lbs. | 1000 lbs. |
| Weight | 8 oz/yd$^2$ | 6 oz/yd$^2$ |
| Trapezoidal Tear Strength | 200 lbs. | 120 lbs. |
| Apparent Opening Size (AOS) | 0.425 mm | 0.425 mm |
| Permittivity | 0.15 sec$^{-1}$ | 0.05 sec$^{-1}$ |
| Hydraulic loading rate | 4.1 gpm/ft$^2$ | 2.5 gpm/ft$^2$ |

[1]Minimum Average Roll Values (MARV) is calculated as the average minus two standard deviations. Statistically, it yields approximately 97.5% degree of confidence that any samples taken from quality assurance testing will meet or exceed the values described above.

As shown above, filtration fabric 130 was found to have a greater tear strength and puncture resistance than the prior two-layer fabric, indicating that filtration fabric 130 is more resilient against tearing, compared to the prior fabric, when used for runoff filtration in a stormwater chamber. Additionally, filtration fabric 130 was also found to have a greater permittivity, which is a measure of the rate at which water flows through a material. Specifically, filtration fabric 130 was found to have a permittivity of 0.15 sec$^{-1}$, while the prior fabric was found to have a lower permittivity of 0.05 sec$^{-1}$. This finding indicates that filtration fabric 130 may filter runoff at a greater rate than the prior fabric, allowing runoff to be released from the stormwater chamber 110 more quickly and minimizing the likelihood that the capacity of stormwater chamber 110 will be exceeded by additional runoff. This conclusion was borne out by the measurement of each fabric's hydraulic loading rate, which is a measure of the volume of water that can pass through a given area of media during a set duration of time. Filtration fabric 130 was found to have a hydraulic loading rate of 4.1 gpm/ft$^2$, compared to the prior fabric's hydraulic loading rate of 2.5 gpm/ft$^2$. This finding suggests that the single-layer filtration fabric 130 filters runoff at a greater rate than the prior, two-layer fabric of the same size.

As another example, the filtration efficacy of stormwater management system 100, including filtration fabric 130, was evaluated according to the protocols of the New Jersey Corporation for Advanced Technology's (NJCAT's) Technology Verification Program. Specifically, two stormwater chambers were installed underground, each chamber having a similar configuration as stormwater chamber 110 depicted in FIG. 3A. A total of 16 sediment removal efficiency testing runs were completed in which runoff having a controlled flow rate and a controlled influent sediment concentration was supplied to the stormwater chambers.

The results from all 16 runs were used to calculate the overall cumulative removal efficiency of the stormwater management system 100. The results of this test indicated that stormwater management system 100 has a sediment removal rate of 81.2%. The New Jersey Department of Environmental Protection (NJDEP) test protocol requires a sediment removal rate of at least 80% to verify the efficiency of a stormwater filtration system; a sediment filtration rate of 80% is also the industry standard for evaluating sediment filtration efficiency. See N.J. Admin. Code § 7:8-5.5 (2016). Accordingly, stormwater management system 100 not only filters runoff at a faster rate than prior technologies but also maintains highly efficient runoff filtration that exceeds the applicable legal and industry standards.

The foregoing description has been presented for purposes of illustration. It is not exhaustive and is not limited to precise forms or embodiments disclosed. Modifications and adaptations of the embodiments will be apparent from consideration of the specification and practice of the disclosed embodiments. For example, while certain components have been described as being coupled to one another, such components may be integrated with one another or distributed in any suitable fashion.

Moreover, while illustrative embodiments have been described herein, the scope includes any and all embodiments having equivalent elements, modifications, omissions, combinations (e.g., of aspects across various embodiments), adaptations and/or alterations based on the present disclosure. The elements in the claims are to be interpreted broadly based on the language employed in the claims and not limited to examples described in the present specification or during the prosecution of the application, which examples are to be construed as nonexclusive. Further, the steps of the disclosed methods can be modified in any manner, including reordering steps and/or inserting or deleting steps.

The features and advantages of the disclosure are apparent from the detailed specification, and thus, it is intended that the appended claims cover all systems and methods falling within the true spirit and scope of the disclosure. As used herein, the indefinite articles "a" and "an" mean "one or more." Similarly, the use of a plural term does not necessarily denote a plurality unless it is unambiguous in the given context. Words such as "and" or "or" mean "and/or" unless specifically directed otherwise. Further, since numerous modifications and variations will readily occur from studying the present disclosure, it is not desired to limit the disclosure to the exact construction and operation illustrated and described, and, accordingly, all suitable modifications and equivalents may be resorted to, falling within the scope of the disclosure.

Other embodiments will be apparent from consideration of the specification and practice of the embodiments disclosed herein. It is intended that the specification and examples be considered as example only, with a true scope and spirit of the disclosed embodiments being indicated by the following claims.

What is claimed is:

1. A flared end ramp for managing a flow of material into a stormwater chamber, the flared end ramp comprising:

an inlet end configured for connection with a pipe or a drainage structure;

an outlet end configured for placement within the stormwater chamber; and an inclined surface extending between the inlet end and the outlet end of the flared end ramp and configured to deliver material from the pipe into the stormwater chamber; and wherein the inclined surface includes at least one drainage groove extending between the inlet end of the flared end ramp and the outlet end of the flared end ramp configured to promote the flow of material towards the stormwater chamber; and wherein the at least one drainage groove includes:

a first drainage groove extending along a midline of the inclined surface or being angled laterally outward from the inlet end toward the outlet end; and a second drainage groove angled laterally outward from the inlet end toward the outlet end.

2. The flared end ramp of claim 1, further comprising:

at least one support foot configured to support the flared end ramp, the at least one support foot being located at the outlet end of the flared end ramp and extending laterally from the flared end ramp.

3. The flared end ramp of claim 2, wherein the flared end ramp includes a support foot extending laterally between a first side of the outlet end and a second side of the outlet end, the support foot forming the widest portion of the flared end ramp.

4. The flared end ramp of claim 2, wherein the at least one support foot is configured to secure the flared end ramp relative to the stormwater chamber.

5. The flared end ramp of claim 1, wherein the stormwater chamber is an open-bottom chamber or a cylindrical pipe.

6. The flared end ramp of claim 1 further comprising a side wall of the flared end ramp, the side wall having a semi-circular profile or an annular profile at the inlet end.

7. The flared end ramp of claim 1, wherein the at least one drainage groove is configured to promote runoff flow along a midline of the flared end ramp and into the center of the stormwater chamber.

8. The flared end ramp of claim 1, wherein the at least one drainage groove is configured to promote runoff flow away from the center of the stormwater chamber and towards the chamber side walls.

9. The flared end ramp of claim 1, wherein the inlet end of the flared end ramp is configured to conform to an outer surface of the pipe.

10. The flared end ramp of claim 1, wherein the inlet end of the flared end ramp is configured for placement within the stormwater chamber.

11. The flared end ramp of claim 1, wherein the inlet end of the flared end ramp is configured to convey material away from an end cap of the stormwater chamber.

12. A method for forming a stormwater chamber, flared end ramp, and inlet cap system for managing flow of material into a stormwater chamber, the method comprising:

providing a flared end ramp having a first end and a second end, and a ramp surface configured to incline from the first end to the second end, the ramp surface including at least one drainage groove extending between the first end and the second end;

forming a support foot attached to the ramp;

providing a stormwater chamber inlet end cap;

connecting the flared end ramp to the chamber inlet end cap; and attaching the ramp and end cap to the stormwater chamber.

13. The method of claim 12, wherein the flared end ramp comprises a curved surface meeting and conforming with a shape of an end of a cylindrical stub pipe connected to the inlet end cap.

14. The method of claim 12, wherein the flared end ramp is configured to connect to an interior surface of the inlet end cap.

15. The method of claim 12, further comprising:

providing a stub pipe; and wherein the flared end ramp is connected to the inlet end cap through an intermediate connection with the sub pipe.

16. The method of claim 12, wherein the chamber inlet end cap is configured to attach to the stormwater chamber and form a chamber enclosure.

17. The method of claim 12, wherein the at least one drainage groove includes:

a first drainage groove extending along a midline of the inclined surface; and a second drainage groove angled laterally outward from the inlet end toward the outlet end.

18. A method for containing and filtering stormwater runoff, the method comprising:

providing an inlet apparatus configured to receive runoff from a surface-level drain, the inlet apparatus including at least one of an elevated bypass manifold or an overflow weir;

providing a first stormwater chamber configured for placement underground, the first stormwater chamber being configured to store the runoff and extending between a first end cap with at least one opening and a second end cap;

providing at least one additional stormwater chamber arranged side-by-side with the first stormwater chamber to form an array of stormwater chambers, wherein the array of stormwater chambers is fluidly connected via the inlet apparatus and is configured to receive the runoff from the inlet apparatus wherein each additional stormwater chamber is configured to store stormwater between a first end cap with at least one opening and a second end cap; and providing a flared end ramp configured for placement within at least one of the stormwater chambers, the flared end ramp including:

an inlet end configured for connection with an inlet pipe, the inlet pipe extending through the at least one opening in the first end cap of the at least one stormwater chamber and connecting to the inlet apparatus;

an outlet end configured for placement within the at least one stormwater chamber; and an inclined surface extending between the inlet end and the outlet end of the flared end ramp and configured to deliver material from the pipe into the at least one stormwater chamber, wherein the inclined surface includes at least one drainage groove extending between the inlet end of the flared end ramp and the outlet end of the flared end ramp.

19. The method of claim 18, wherein the array of stormwater chambers comprise open-bottom chambers or cylindrical pipes.

* * * * *